US005996699A

United States Patent [19]

Sundholm

[11] Patent Number: 5,996,699

[45] Date of Patent: Dec. 7, 1999

[54] INSTALLATION FOR FIGHTING FIRE

[76] Inventor: Göran Sundholm, Ilmari Kiannon kuja 3, Fin-04310, Tuusula, Finland

[21] Appl. No.: 09/051,222

[22] PCT Filed: Sep. 5, 1997

[86] PCT No.: PCT/FI97/00522

§ 371 Date: Apr. 3, 1998

§ 102(e) Date: Apr. 3, 1998

[87] PCT Pub. No.: WO98/09683

PCT Pub. Date: Mar. 12, 1998

[30] Foreign Application Priority Data

Sep. 5, 1996 [FI] Finland ..... 963486

[51] Int. Cl.[6] ..... A62C 13/62; A62C 35/00; B05B 7/30

[52] U.S. Cl. ..... 169/9; 169/16; 169/71; 239/342; 239/344; 239/372

[58] Field of Search ..... 239/342, 344, 239/372; 169/5, 9, 16, 71, 85, 6

[56] References Cited

U.S. PATENT DOCUMENTS

| | | | |
|---|---|---|---|
| 281,942 | 7/1883 | Sutton | 239/372 |
| 3,870,069 | 3/1975 | Etter | 239/372 X |
| 5,676,210 | 10/1997 | Sundholm | 169/71 X |

OTHER PUBLICATIONS

Derwent Abstract No. 91–49577/07, week 9107, abstract of SU 1570736 entitled, "Foam Jet Fire Extinguisher . . . on Float" Jan. 9, 1988 to E Mine Rescue Res.

Derwent Abstract No. 89–315041/43, week 8943, Abstract of SU 1740307 entitled "Powder–Type Fire Extinguisher . . . Agitates Powder" of Mar. 8, 1987 to M.E. Azovskov.

International Publication No. WO 94/08659 to G. Sundholm entitled, "Method and Installation for Fighting Fire" dated Apr. 28, 1994.

*Primary Examiner*—Kevin Weldon
*Assistant Examiner*—Robin O. Evans
*Attorney, Agent, or Firm*—Watson Cole Grindle Watson, P.L.L.C.

[57] ABSTRACT

An installation for fighting fire, having a hydraulic accumulator which has at least one pressure container with a space for extinguishing liquid and a space for propellant gas, a rising tube arranged in the pressure container and provided with a side opening and, at the lower part of the pressure container, a feed opening for feeding extinguishing liquid into the rising tube and further to at least one nozzle. In order to obtain an extremely small drop size of the extinguishing liquid at the final stage of the emptying of the pressure container and in order to manage with a very small amount of extinguishing liquid, the rising tube has a throttle in an area below the uppermost side opening.

19 Claims, 2 Drawing Sheets

INSTALLATION FOR FIGHTING FIRE

BACKGROUND OF THE INVENTION

1. Field of the Invention

The present invention relates to an installation for fighting fire, including a hydraulic accumulator which includes at least one pressure container with a space for extinguishing liquid and a space for propellant gas, a rising tube, in the pressure container, provided with a side opening and, at the lower part of the pressure container, with a feed opening for feeding extinguishing liquid into the rising tube and further to at least one nozzle.

2. The Prior Art

Such installations are known from, for example, WO 94/08659. The principal of operation is that only liquid in a mist-like, penetrating form is initially sprayed from the nozzle, after which gas is mixed into the liquid through said the openings. A reduction of the pressure in the pressure container generally produces a spray with a larger drop size out of the nozzle. Owing to the feeding of gas, the drop size of the extinguishing medium discharged from the nozzle can be reduced. These known installations largely function very well; however, in some applications, it would be desirable to be able to reduce the size of the drops discharged from the nozzle even more, after the initial spraying with a great penetration, than what has been possible with the known hydraulic accumulators and nozzles. The mixing of a large amount of gas into a small amount of liquid has been relatively difficult to achieve in practice. An enlarging of the side openings in the rising tube has not produced the desired result, but by reducing the diameter of the rising tube, it has been possible to improve the intermixing of gas somewhat. However, a reduction of the diameter of the rising tube increases the pressure losses as the flow resistance of the liquid in the rising tube increases, and sufficient liquid cannot be obtained from the pressure container upon emptying the container. By being able to produce very small droplets, the amount of extinguishing liquid that is used could be minimized and, simultaneously, if water was used as the extinguishing liquid, the water damages would be minimal. This has not always been possible to achieve to such a degree as one would have wished.

SUMMARY OF THE INVENTION

The present invention relates to a new installation for fighting fire by means of which a very finely divided mist, when a pressure accumulator is used, can be easily produced at the final stage of the extinguishing, after the extinguishing with a mist-like liquid spray with a great penetrating ability and a relatively large drop size has initially been started. The installation can, if desired, easily be realized by mixing gas into the extinguishing liquid already when the emptying of the pressure container is started.

To produce such an extinguishing medium with a very finely divided mist with extremely small droplets, the invention is characterized in that the rising tube of the pressure container has a throttle in an area below the side opening.

By arranging the throttle below the lowermost side opening, gas can flow efficiently in through all the side openings, when the liquid level has sunk below the lowermost side opening. If the throttle was located above the lowermost side opening, only liquid could flow in through the lowermost side opening at the end of the emptying of the pressure container.

By arranging side openings at at least three different height levels in the rising tube, good results are achieved for many applications. In some cases, it would be possible to arrange side openings only at two different height levels or only one side opening.

Preferably, the pressure container is filled with water or a water-based liquid, whereby a gas source which is filled with nitrogen and which has a pressure in the range of about 60 to 200 bar is coupled to the pressure container. By using nitrogen, an extinguishing medium with very small droplets is obtained when nitrogen and water are intermixed. The extinguishing medium weighs slightly more than air, wherefore it will sink to the lower part of a room in which it is sprayed. After some time, the nitrogen is liberated from the water mist and rises in the room. When the nitrogen rises, the oxygen content in the room decreases, and an extinguishing effect is thus achieved.

The essential idea of the invention is that a relatively large pressure difference is achieved outside and inside the rising tube by means of the throttle. As a result of the pressure difference, gas is caused to flow efficiently through the side opening/side openings from the outside of the rising tube into the rising tube, when the liquid level has passed the level of the side opening/side openings, whereby an effective mixing of gas into the liquid leaving the rising tube takes place. Such an effective gas flow is not achieved in known constructions, since the pressure difference outside and inside the rising tube—contrary to what has been assumed—is very small. In the known constructions, the gas flows in through the side openings—contrary to what has been assumed—through the ejector effect as the extinguishing liquid, which flows with a high velocity in the rising tube, produces a negative pressure at the side openings which pulls along gas.

The greatest advantage of the present invention is that a very effective mixing of incombustible gas into a small amount of extinguishing liquid is achieved, whereby, by spraying through suitable nozzles, an extinguishing medium mist in the form of a mixture of liquid and gas containing very small droplets is achieved, the drop size being from about 10 to 50 $\mu$m, which very efficiently extinguishes a fire when the fire has first been—as is normally the case—forced down by liquid mist with a larger drop size of about 50 to 250 $\mu$m. It is also conceivable that a constant small drop size of, for example, 10 to 50 $\mu$m may be sustained during the entire extinguishing. Such an extinguishing medium mist can be sprayed so that it first fills the entire room, after which it—depending on the composition of the incombustible gas—can—if the mixture of liquid and gas is heavier than air—sink towards the floor, after which the gas component of the liquid and gas mixture, if it is lighter than air, can after a period of time be liberated from the liquid and rise, whereas the liquid mist sinks down.

The invention shall be described in the following with reference to one embodiment by means of the appended drawings

DETAILED DESCRIPTION OF THE PREFERRED EMBODIMENT

Figure 1:
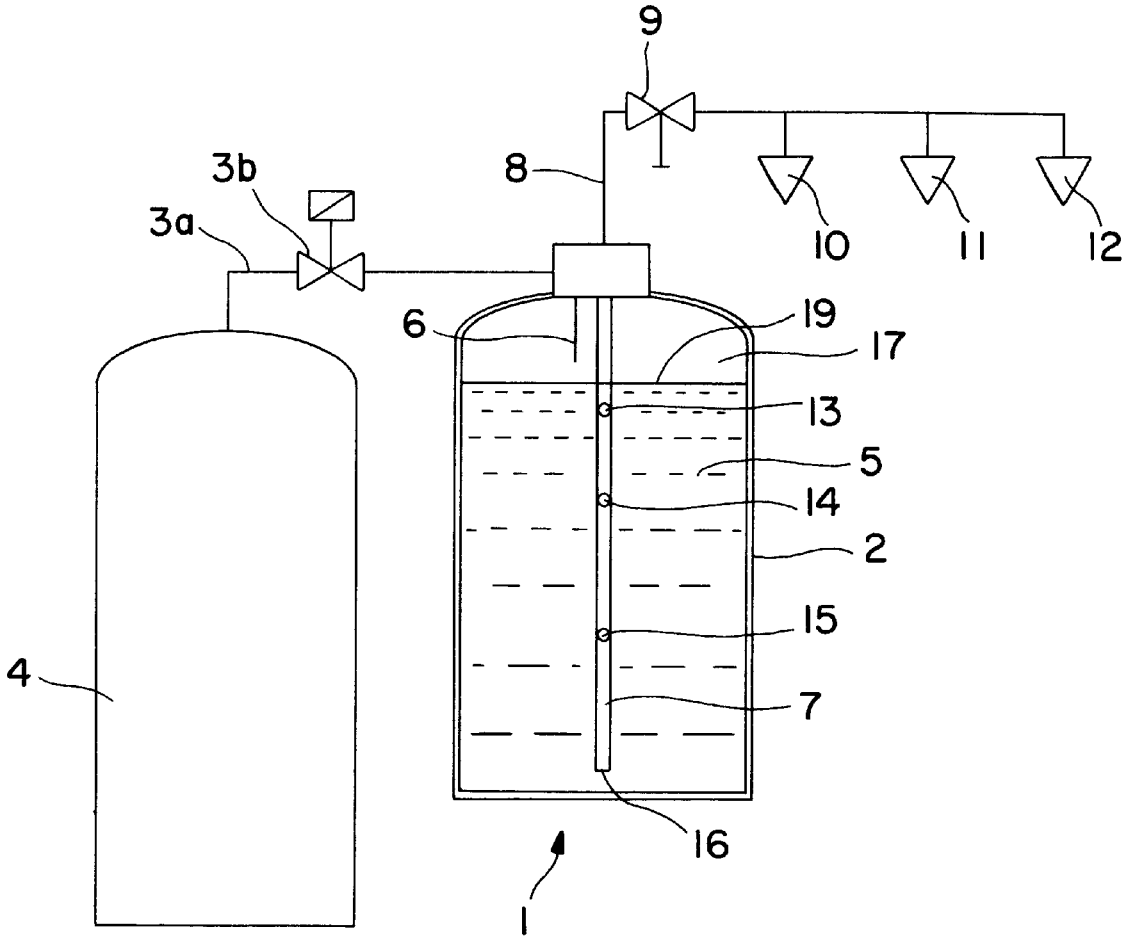
FIG. 1 PRIOR ART
FIG. 1 shows prior art.

In FIG. 1, which shows prior art, the reference numeral 1 indicates a hydraulic accumulator which consists of a pressure container 2 for liquid. A gas bottle 4 has been coupled to the pressure container 2 through a conduit 3*a* with a valve 3*b*. The space 5 of the pressure container 2 contains water, the volume of the space being typically about 50 l. The gas bottle 4, which has a volume of about 50 l, contains nitrogen or some other incombustible gas. The pressure in the gas bottle is typically from 100 to 300 bar before an extinguishing process is initiated. The advantage of using nitrogen is that a suitable weight for the extinguishing medium is achieved so that the extinguishing medium can first settle against the floor and the gas component of the extinguishing medium can later rise, as it appears from the above.

The pressure container 2 comprises a gas feeding pipe 6 connected to the conduit 3*a* and a rising tube 7 which extends down from the pressure container up to an outfeed pipe 8 which via a valve 9 leads to a number of nozzles 10 to 12. The number of nozzles can of course vary. The rising tube 7 comprises a number of side openings 13 to 15 at a distance from one another and, at the lower end, a feed opening 16.

When an installation according to FIG. 1 is put into operation, the valve 9 opens and the valve 3*b* is kept open. Nitrogen gas is then fed into the upper part of the pressure container, i.e. the space 17, in which an initial pressure of, for example, 180 bar is formed. The nitrogen functions as propellant gas for driving out water from the pressure container 2. The water flows as a result of the gas pressure in through the feed opening 16 of the rising tube 7 and somewhat through the side openings 13 to 15. On emptying the pressure space, the water level 19 sinks, whereby the volume of the space 17 for gas increases. Initially, only water flows through the rising tube 7, until the water level 19 has sunk to the place where the side opening 13 is located. Nitrogen gas then starts to be mixed into the water as nitrogen gas flows through the side opening 13. The gas pressure has fallen to a value under 180 bar when the water level has sunk to the level of the side opening 13. When the emptying of the pressure container 2 proceeds, at the same time as the pressure in the pressure container falls, the water level gradually reaches the level where the side opening 14 is located. Nitrogen gas is then also fed in through the side opening 14. The emptying of the pressure container 2 continues until the side opening 15 has been passed and the pressure space has been emptied of water.

Figure 2:
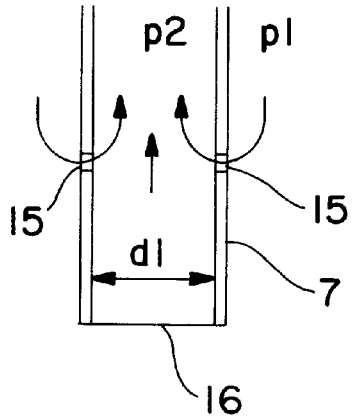
FIG. 2 PRIOR ART
FIG. 2 shows a detail of FIG. 1.

When the pressure space 2 according to FIG. 1 is emptied in the above described manner, it is not possible to obtain extremely small droplets, e.g. from 10 to 20 $\mu$m, at the end of the emptying process. This is due to the fact that the main driving force which causes gas to flow in through the side openings 13 to 15 is based on the ejector effect of the water jet which flows in the rising tube 7. This ejector effect can be increased when the diameter d1 (cf. FIG. 2, which shows a section of the rising tube 7) is reduced: a reduced diameter d1 results in a faster flow of the water, which in turn produces a stronger suction and ejection effect. However, it has not been possible to use very small diameters d1, since in that case it would not be possible to obtain a sufficiently great water flow per time unit. Since the pressure p1—in FIG. 2 outside the rising tube 7 is very near the pressure p2 inside the rising tube, it has also not been possible to produce—by the pressure difference p1−p2−a flow of nitrogen gas through the side opening 15. This has particularly been the case when only a small number of nozzles that are put into operation, e.g. only the nozzle 11, has been released. If a larger series of nozzles 10 to 12 has been released, it has been possible to achieve a small pressure difference p1−p2, but not a pressure difference sufficiently large to make the intermixing of gas very efficient, which would be vital in order to keep the drop size of the extinguishing medium very small.

Figure 3:
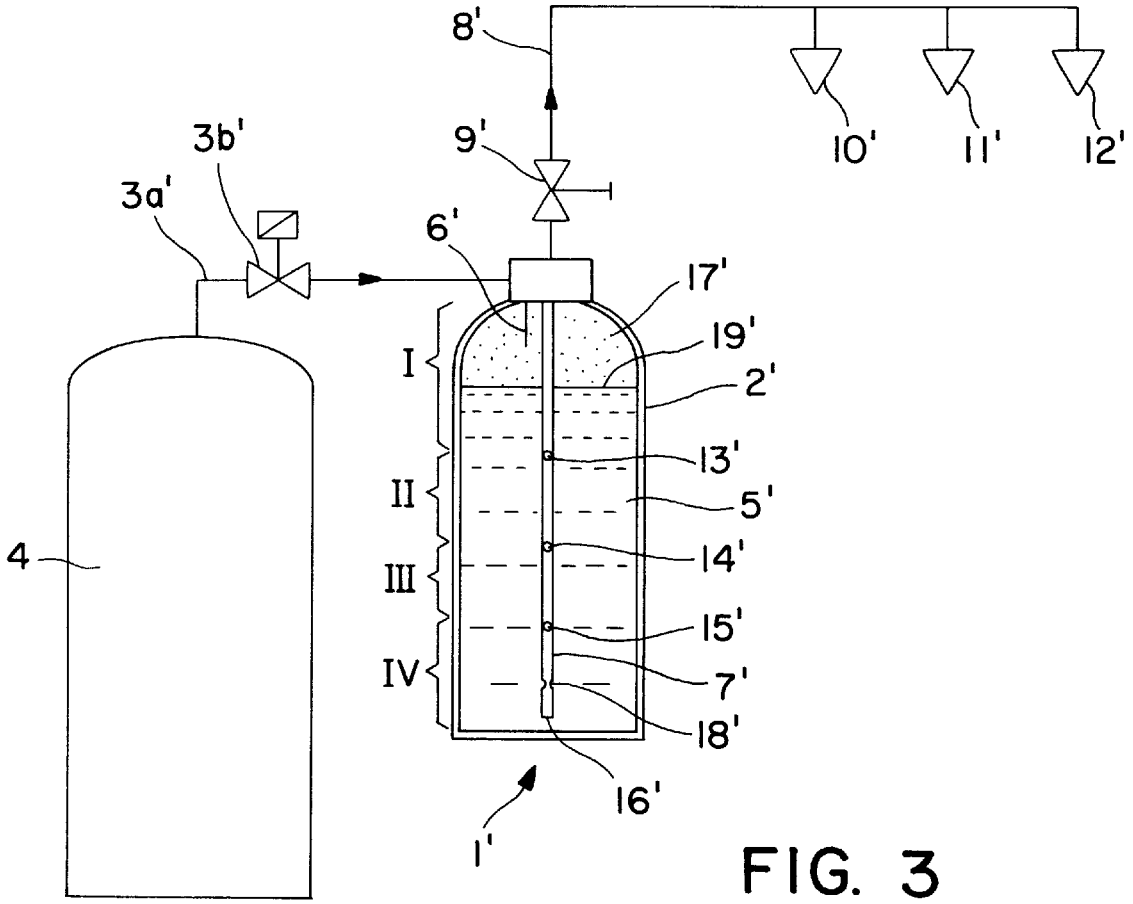
FIG. 3 shows the present invention.
Figure 4:
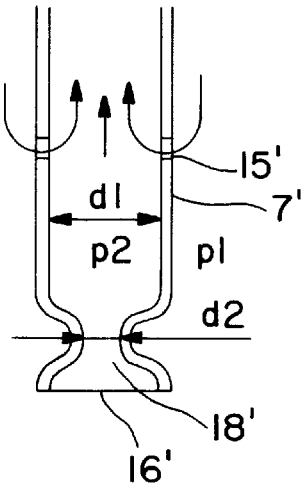
FIG. 4 shows a detail of FIG. 3.

FIG. 3 shows a simple embodiment of an installation according to the present invention. Reference marks corresponding to those of the corresponding parts in FIG. 1 have been used.

The invention in FIG. 3 differs from the known construction in FIG. 1 therein that the rising tube 7' at its lower part is throttled by a throttle 18'. The throttle 18' has been formed as a constriction made in the lower end of the rising tube 7' below the lowermost side opening 15'. The throttle 18' forms an aperture 18' with the diameter d2=0.5 mm, whereas the nominal diameter d1 of the rising tube 7' is typically in the range of 8 to 15 mm. The aperture 18' preferably has the diameter d2=0.2 to 4 mm and most preferably 0.3 to 2mm. The selection of the diameter d2 for the aperture 18' depends on many factors, such as the type of nozzles 10', 11', 12', the number of nozzles, the propellant pressure in the gas bottle 4', the type of gas, the diameter d1 of the rising tube 7', the size and number of the side openings 13' to 15', the intended use of the installation, i.e. the type of fire to be fought.

As a result of the throttle 18', a greater pressure difference p1−p2 is formed, at the side openings 13', 14' and 15', outside and inside the rising tube 7'. This pressure difference, which can, for example, be in the order of 50 bar, causes nitrogen gas to flow efficiently in through the side openings 13' to 15' when the water level in the pressure container 2' has sunk to a level below the side opening 13'. Due to the fact that gas can flow efficiently into the side openings as the pressure container 2' is emptied, it is possible to obtain, as a result, a drop size of the sprays discharged from the nozzles 10' to 12' that is very small at the end of the extinguishing. The system functions successively so that the proportion of gas/water is determined by the location of the water level 19' in the pressure bottle 2'. At first, the side openings 13' to 15' and the feed opening 16' provide only water through the throttle 18' into the rising tube 7'. When the water level 19' has reached the side opening 13', the side opening 13' starts to feed gas into the rising tube 7', while the rest of the side openings 14', 15' and the feed opening 16' provide water through the throttle 18'. At this water level, the pressure is still comparatively high, whereby the amount of gas which is required to obtain small droplets is comparatively small. The drop size increases with the falling pressure if the rest of the parameters are kept unchanged. Consequently, when the pressure falls, more gas is successively required to obtain small droplets. When the water level has sunk to the side opening 14', the amount of gas increases and the amount of water is reduced. This is due to the fact that both side openings 13' and 14' provide gas, whereas only the side opening 15' and the feed opening 16' provide water through the throttle 18'. When the water level has reached a level below the side opening 15', the amount of gas that is intermixed is very large in relation to the amount of water, which only flows from the feed opening 16' through the throttle 18'.

The spray heads and/or the sprinklers in which the nozzles have been mounted are preferably of the type described in the publications WO 92/20453, WO 92/22353 and WO 94/16771.

If the throttle 18' is formed by an aperture with a diameter d2 that is small in relation to the diameters of the side openings 13' to 15', the pressure difference p1−p2 grows very large and liquid can flow in through the side openings. The diameter of the side openings is preferably between 0.5 and 5 mm and most preferably between 1 and 3 mm. In the embodiment in FIG. 3, the rising tube 7' has a side opening 13' with a diameter of 2 mm in the upper part, two side openings 15' with a diameter of 2 mm in the lower part and, about half-way between said side openings 13' and 15', a side opening 14' with a diameter of 2 mm so that the pressure container 2' is divided into four sections I to IV of approximately the same size. As there are three side openings 13' to 15' located at a distance from one another, the lowermost side opening 15' being located in the lower part of the rising tube 7' and the uppermost side opening 13' being located in the upper portion of the rising tube, an efficient mixing of gas into the water is achieved for a long period of time during the emptying of the pressure container 2'. By making the lowermost opening 15' larger than the rest of the side openings, an extremely efficient intermixing of gas is achieved towards the end of the emptying of the pressure container 2'. Since the intermixing of gas is efficient, a small amount of water will suffice. In FIG. 3, the volume of the pressure container 2' is only 5 l compared to 50 l in FIG. 1.

In FIG. 3, the throttle 18' has been arranged below the lowermost side opening 15', whereby a large pressure difference is achieved at all the side openings 13' to 15', which is advantageous in the attempt to mix as large a quantity of gas as possible into the water. It is, however, conceivable that the throttle 18' may be arranged at a different place, e.g. between the side openings 13' and 14', whereby a larger pressure difference is achieved only at the side opening 13'. It is important for the invention that the throttle 18' has been arranged below the uppermost side opening 13', whereby a greater pressure difference is achieved at least at this side opening, causing gas to flow in through the side opening when the water level has sunk to the height level of this side opening.

The water in the pressure container 2 may or may not contain additives.

Instead of nitrogen, the gas bottle 4' may contain some other incombustible gas, such as argon or carbon dioxide. Incombustible gas which weighs less than air is to be preferred, if it is wished that the gas can later rise so that an extinguishing effect is achieved higher up in the room. Consequently, nitrogen may well be used.

The invention has in the foregoing been described with reference to only one embodiment and it is therefore pointed out that the invention can vary as regards its details in many ways within the scope of the enclosed claims. Thus the throttle can be constructed, for example, as an aperture which has been made in the pipe wall of the rising tube at the lower end of the rising tube. The number of side openings in the rising tube can be much larger than what has been shown in the figures. It is also conceivable that there may only one side opening, although at least two side openings located at a distance from one another in the longitudinal direction of the rising tube is to be preferred. The sole function of the valve 9' is to stop the feed of liquid to the nozzles; the valve is thus not necessary for the invention.

I claim:

1. Installation for fighting fire, comprising a hydraulic accumulator (1') which comprises at least one pressure container (2') defining a lower space (5') for extinguishing liquid and an upper space (17') for propellant gas, and a rising tube (7') positioned in the pressure container, said rising tube including a feed opening (16') for feeding extinguishing liquid into the rising tube and upwardly therein to at least one nozzle (10' to 12'), first and second vertically spaced apart side openings above the feed opening, and a throttle therein below at least one of said first and second side openings.

2. Installation according to claim 1, including gas supply means connected to the pressure container (2') to provide the pressure container (2') with propellant gas.

3. Installation according to claim 1, wherein the throttle is located below both of said first and second side openings.

4. Installation according to claim 1, wherein the throttle is formed by a constriction in the rising tube (7'), whereby the constriction forms an aperture (18') with a diameter of 0.2 to 2 mm in the rising tube.

5. Installation according to claim 4, wherein the aperture (18') has a diameter of 0.3 to 2 mm.

6. Installation according to claim 1, wherein the rising tube (7') has three side openings (13' to 15') which have been placed at a distance from one another in the longitudinal direction of the rising tube so that the lower space (5') for extinguishing liquid of the pressure container (2') in the area between said side openings is divided into sections (II, III) lacking side openings.

7. Installation according to claim 6, wherein the distances between the three side openings (13' to 15') are essentially of the same length.

8. Installation according to claim 6, wherein the diameter of the side openings (13' to 15') is 0.5 to 5 mm.

9. Installation according to claim 8, wherein the diameter of the side openings (13' to 15') is 1 to 3 mm.

10. Installation according to claim 9, wherein rising tube (7') has, at the lower part, at a distance from the feed opening (16') of the rising tube, at least one side opening (15') the diameter of which is larger than the diameter of side openings (13', 14') located higher up in the rising tube.

11. Installation according to claim 2, wherein the gas supply means is a pressure bottle (4') contains incombustible gas.

12. Installation according to claim 11, wherein the pressure bottle contains nitrogen charged to a pressure of from 30 to 300 bar.

13. Apparatus for fighting fire comprising:

a pressure container which defines a lower space for containing extinguishing liquid and an upper space for propellant gas, a pressure bottle containing incombustible gas connected to said pressure container, and a rising tube positioned in the pressure container, said rising tube including a feed opening (16') for feeding extinguishing liquid into the rising tube and upwardly therein to at least one nozzle (10' to 12'), first and second vertically spaced apart side openings above the feed opening, and a throttle therein below at least one of said first and second side openings.

14. Apparatus according to claim 13, wherein said throttle is located below both of said first and second side openings.

15. Apparatus according to claim 13, including a third side opening vertically spaced from said first and second side openings.

16. Apparatus according to claim 13, wherein said throttle is located below all of said first, second and third side openings.

17. Apparatus according to claim 13, wherein said throttle is formed by a construction in said rising tube.

18. Apparatus according to claim 12, wherein said rising tube has an internal diameter of between 8 and 15 mm and said constriction has a diameter of between 0.2 and 4 mm.

19. Apparatus according to claim 18, wherein said constriction has a diameter of between 0.3 and 2 mm.

* * * * *